United States Patent [19]

Lubin et al.

[11] Patent Number: 4,729,472

[45] Date of Patent: Mar. 8, 1988

[54] USE-MONITORING CLOSURE FOR TENNIS BALL CANS

[76] Inventors: Martin Lubin, 21 Lyme Rd., Hanover, N.H. 03755; Adam Lubin, 2 McKenna Rd., Norwich, Vt. 05055

[21] Appl. No.: 881,198

[22] Filed: Jul. 2, 1986

[51] Int. Cl.[4] ..... B65D 85/00; B65D 51/24

[52] U.S. Cl. ..... 206/315.9; 116/201; 116/308; 273/DIG. 26; 215/230; 206/459

[58] Field of Search ..... 206/315.9, 459, 534; 215/230; 116/201, 308

[56] References Cited

U.S. PATENT DOCUMENTS

| | | | |
|---|---|---|---|
| 1,050,706 | 1/1913 | Taylor | 206/315.9 |
| 1,260,546 | 3/1918 | Jenkins | 215/230 |
| 1,425,456 | 8/1972 | Dial | 215/230 |
| 1,621,902 | 3/1927 | Raschick | 215/230 |
| 2,024,889 | 12/1935 | Simeone | 215/230 |
| 2,066,183 | 12/1936 | Mahaffey | 215/230 |
| 2,355,108 | 8/1944 | Reese | 206/606 |
| 2,706,464 | 4/1965 | North | 116/121 |
| 2,767,680 | 10/1956 | Lermer | 116/121 |
| 3,233,727 | 2/1966 | Wilson | 206/315.9 |
| 3,285,459 | 11/1966 | Gahm | 220/8 |
| 3,424,336 | 1/1969 | Perez et al. | 220/42 |
| 3,446,179 | 5/1969 | Bender | 116/121 |
| 3,739,740 | 6/1973 | Fromer | 206/459 |
| 3,888,347 | 6/1975 | Kramer | 206/315.9 |
| 3,960,713 | 6/1976 | Carey | 206/534 |
| 4,419,016 | 12/1983 | Zoltan | 368/10 |
| 4,621,670 | 11/1986 | Yuen | 206/459 |

FOREIGN PATENT DOCUMENTS

| | | | |
|---|---|---|---|
| 241004 | 6/1946 | Switzerland | 206/459 |

OTHER PUBLICATIONS

Tennis Can advertisement, *Packaging* Magazine, vol. 30, No. 9, 8/1985, p. 17.

*Primary Examiner*—William Price

[57] ABSTRACT

A use-monitoring closure for the open top of a tennis ball can including a cap for releasably attaching to and closing the open top, and an adjustable use recorder/-displayer on the cap for recording and displaying the usage of tennis balls within the can.

19 Claims, 3 Drawing Figures

USE-MONITORING CLOSURE FOR TENNIS BALL CANS

BACKGROUND OF THE INVENTION

This invention relates to a closure for a container of tennis balls.

The modern tennis ball, which usually comes packaged three (sometimes four) balls in a metal or plastic cylindrical can, is rather durable. It is common for the tennis balls from a single can to remain in good playing condition for four or five matches, amounting to perhaps six to eight hours of play. However, once the condition of a tennis ball has deteriorated, the ball is no longer either enjoyable or easy to play with. Playing with such balls can also be very bad for one's game: the inconsistent bounces and lack of control of spent tennis balls can lead to poor tennis strokes and form; these same problems can also risk or aggravate tennis injuries, such as tennis elbow. Finally, it can be embarrassing, as well as annoying, to arrive at courtside for a match only to find that the tennis balls one has brought are in poor condition for play.

Some tennis players try to determine the playability of their tennis balls by inspection: they look at the felt covering of the ball to see if it is worn, they bounce the ball from various heights to determine rebound, and they squeeze it to check deflection. For a variety of reasons, however, this sort of examination can be misleading, as well as difficult. Often a tennis ball will still appear fluffy, rather than worn, after it has been bashed about for some time. This is because the felt covering (usually a woven blend of wool and nylon) can puff up; but too much of this fluff is undesirable because it increases the ball's wind resistance, thus slowing it down. Determining whether a ball has enough rebound involves dropping it, several times, from a fixed height onto the court surface and measuring the exact height of its bounce. To check whether a ball has enough deflection, one must squeeze it with a specificed force and note how much it deflects. It is obvious that these tests, even if they can be done accurately, are very time-consuming—especially since one often wants to compare the balls from several open cans and to choose those in the best condition.

In tennis tournaments all of these problems are avoided, and good-playing tennis balls are assured, by the requirement that new cans of balls be opened after a fixed number of games have been played (usually nine). For the average, noncompetitive player this custom of replacing the tennis balls after only a few games is neither economical (because of the expense of tennis balls) nor necessary (because of their durability). With the average player a tennis ball's useful life can be measured in a few matches or several sets or hours of play, the exact number being fairly constant for a given individual, though varying among players depending upon their level of skill and the type of court surface and brand of ball they use. In fact, replacement of a can of tennis balls after such a fixed amount of use is just what the typical tennis player tries to do. For the average player, however, there is often a period of some days, or even weeks, between successive matches; the average player also often has more than one opened can of tennis balls in his possession. For these reasons it is often very difficult to remember exactly how much use a particular can of tennis balls has had.

SUMMARY OF THE INVENTION

We have discovered that tennis ball usage can be easily and reliably monitored by providing a cap for releasably attaching to and closing the open top of a tennis ball can with an adjustable use recorder/displayer to record and display the usage of the tennis balls within the can. Because the use recorder/displayer is part of the can closure, every time a tennis player removes the balls from the closed can he is forced to observe the use information present on the closure. Likewise, every time he is finished playing with the balls and returns them to their can, he is again presented with the use information on the closure and is reminded to update that information in light of the additional amount of use the tennis balls have just had.

In preferred embodiments the cap snap fits to the top of the can, and the recorder/displayer is a member that moves along a predetermined path on the cap adjacent to indicia on the cap indicating usage, e.g., numerals indicating hours or sets of tennis play; the movable member is a rotatable pointer secured to the cap by an enlarged head and post passing through a hole through the cap; and the pointer is raised above the surface of the cap by a hub on the pointer and an annular ledge on the cap. The pointer can be easily moved with a single finger tip, yet once moved to a new setting, it is secure against unintentional or accidental movement (including accidental movement caused by snapping the cap on and off the can). The entire closure is very durable and affords excellent protection of the tennis balls from moisture and dirt.

Other advantages and features of the invention will be apparent from the following description of a preferred embodiment thereof and from the claims.

DESCRIPTION OF PREFERRED EMBODIMENT

The drawings will be briefly described first.

DRAWINGS

STRUCTURE

Figure 1:
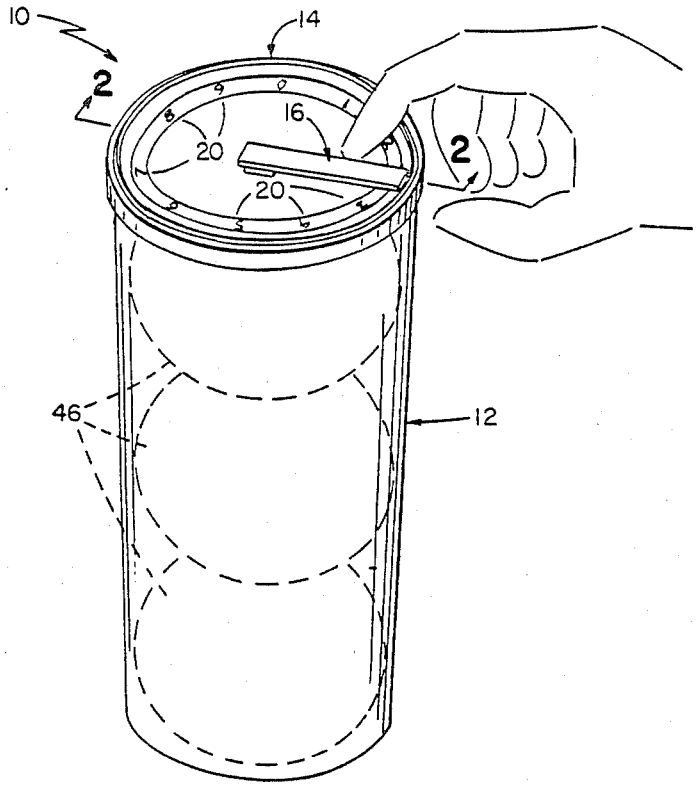
FIG. 1 is a perspective view of a use-monitoring closure according to the invention, shown attached to the open end of a tennis ball can.
Figure 3:
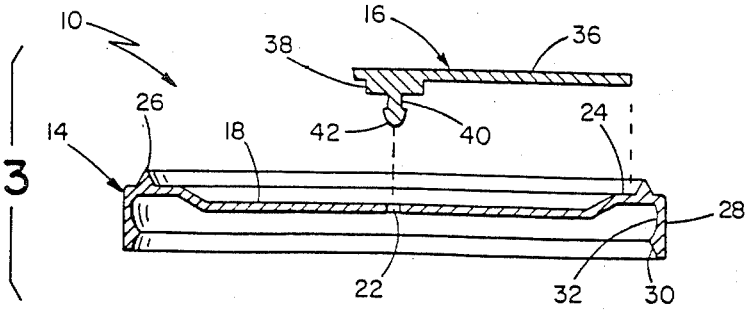
FIG. 3 is a vertical sectional view of the two parts of the FIG. 1 closure, shown before their assembly.

Referring to the drawings, there is shown in FIG. 1 use-monitoring closure 10 attached to the top end of conventional, cylindrical tennis ball can 12. As illustrated in FIG. 3, use-monitoring closure 10 is assembled from two parts, snap-on cap 14 and rotatable pointer 16.

Figure 2:
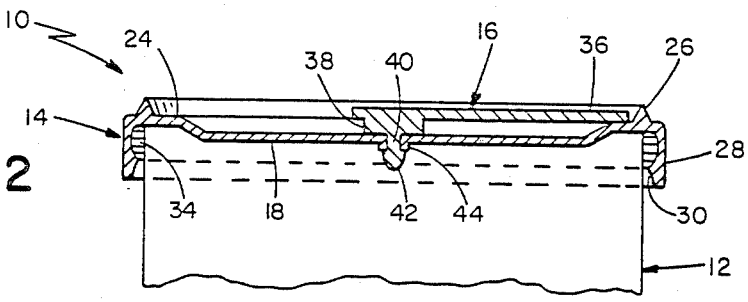
FIG. 2 is a partial vertical sectional view, taken along 2—2 of FIG. 1, of the FIG. 1 closure and can.

Cap 14 has flat, circular central panel 18 around the periphery of which are imprinted use indicia 20 (FIG. 1), consisting of the digits 0 through 9, equidistantly spaced in a complete circle. At the center of panel 18 is small circular hole 22 (approximately 0.020" in diameter before assembly, FIG. 3). Surrounding panel 18 is a raised annular ledge 24. Projecting upwardly along the top surface of ledge 24 is narrow rib 26, displaced inwardly from the outer edge approximately one-third of the width of ledge 24. The outer edge of ledge 24 merges into a downwardly projecting peripheral skirt 28. On the inner surface of skirt 28 is annular bead 30, forming annular pocket 32 (having a diameter of about 2.96") into which the top end seam 34 of the tennis ball can 12 fits when closure 10 is snapped onto it, as shown in FIG. 2. The lower portion of annular bead 30 is beveled slightly outwardly and downwardly to cause skirt 28 to flex outwardly during the snapping operation so bead 30 easily passes over end seam 34.

Cap 14 is preferably molded as a unitary structure out of a soft plastic material such as polyethylene or polypropylene, with a thickness of approximately 25 mils across panel 18, ledge 24, and the upper portion of skirt 28 and a thickness of about twice this amount across the width of bead 30. This choice of material and thickness provides cap 14 with sufficient flexibility, as well as durability, to be readily and repeatedly snapped on and snapped off tennis ball can 12.

Pointer 16 has thin (1/32" thick), rectangular-shaped bar 36, of length approximately one-half of the diameter of cap 14, cylindrically-shaped hub 38 dependent from the bottom surface of one end of bar 36, and, projecting downwardly from hub 38, short vertical post 40 (approximately 0.063" long and 0.093" in diameter), with an enlarged, somewhat pointed, head 42 (approximately 0.078" long and 0.105" in diameter).

Pointer 16 is assembled to cap 14 by forcing head 42 and post 40 through hole 22 so that one end rests on the inner portion of ledge 24 and the other end is rotatably pivoted at the center of panel 18. Head 42 and post 40 are of a much larger diameter than hole 22. As a consequence, when head 42 and post 40 are forced through hole 22, that portion of panel 18 immediately surrounding central hole 22 is stretched downward and outward and forms annular skirt 44 around post 40 and base of head 42, as shown in FIG. 2. The forces of reaction of the plastic of this annular skirt 44 against its stretched deformation serve to pull head 42, post 40, and hub 38 into tight contact with annular skirt 44. This contact provides frictional resistance to rotation which, while large enough to secure pointer 16 against unintentional movement from its set position, is small enough to allow the force of a single finger tip to reset pointer position when required. The diameter of hub 38 is more than twice that of head 42, and is sufficient to completely seal off the top surface of annular skirt 44 and so prevent the entry of dirt and moisture into can 12 of tennis balls 46. However, if for some reason leakage at this seam should occur, the tight fit of annular skirt 44 around post 40 and the base of head 42 provides an additional seal against moisture and dirt contamination of tennis balls 46 within can 12.

Pointer 16 is preferably molded as a unitary structure from a plastic material which is harder than the plastic of cap 14, for example nylon or polystyrene. The choice of harder plastic for pointer 16 facilitates the effective formation of the pivot structure described above; yet it allows pointer 16 to be flexed easily when closure 10 is snapped on, or snapped off, a tennis ball can 12, because pointer bar 36 of pointer 16 10 is relatively thin (1/32"). In spite of the thinness of pointer bar 36, however, the tip of a person's finger can effect substantial engagement with the edge of pointer bar 36 in order to reset the latter's position, because bar 36 is supported some distance (approximately 50 mils) above the surface of panel 18 by ledge 24 at one end and by hub 38 at its other end. Rib 26, which runs around the top surface of ledge 24, is preferably about 35 mils high, and because it is somewhat higher than the thickness of bar 36, it serves to prevent the adjacent end of bar 36 from being caught or snagged on objects during handling and storage of tennis ball can 12.

Additional functions of both ledge 24 and rib 26 are to provide structural rigidity to cap 14, to help maintain the resilient biasing of peripheral skirt 28 against the side of tennis ball can 12, and to provide a hinge point to facilitate snapping cap 14 on and off can 12.

As described above, use-monitoring closure 10 is preferably fabricated by the molding of two relatively uncomplicated plastic parts which are then assembled in a single step, i.e., pushing them together. This simple design allows closure 10 to be manufactured at very low cost. Another advantage of both the simplicity and the flexibility of this plastic structure is that it imparts exceptional durability to use-monitoring closure 10. This durability is especially important because tennis ball cans tend to receive a fair amount of abuse: they get kicked and stepped on on the tennis court, and they get stuffed or thrown into equipment bags, lockers, trunks of cars, and closets.

USE

In employing the present invention to monitor the amount of use of his tennis balls, a tennis player can let the numerals on closure 10 represent any unit of measure of use that he finds convenient, such as number of matches, sets, hours, or games played. Each time he plays with a particular can of tennis balls, the player would simply increment the setting of pointer 16 by the additional amount of use that the balls have had. Because of the analog nature of the use-indication provided by the circularly-disposed indicia 20 on closure 10, a player can keep track of fractional units of use as well as whole units, where this is appropriate; e.g. if one is accumulating hours of use, and one plays with the balls for an hour and a half, a pointer setting exactly midway between two digits can represent the half hour.

Although use indicia 20 consist of just the numerals 0–9, few if any tennis players would find this limiting. The reason is that for almost all tennis players—with the possible exception of beginners—tennis balls are completely spent within ten hours or sets of play, and most players are likely to choose one of these units of use (or the generally larger unit of matches played) to monitor the condition of their tennis balls, rather than a smaller unit such as games played. In any case, for those rare cases when a can of balls does accumulate more than ten units of play, one can let the pointer begin a new revolution of the dial, and then one must simply recall that the new settings are actually ten more than they read. There will probably be little difficulty in doing this, because a visual inspection should make it obvious whether a ball has for example two hours of play on it or twelve.

OTHER EMBODIMENTS

Other embodiments of the invention are within the scope of the following claims.

E.g., instead of the numerals 0–9, one could have more numerals, e.g., 0–16, to record larger amounts of usage. Also, although in our preferred embodiment the digits 0 through 9 are imprinted around the periphery of central panel 18, these digits could be imprinted elsewhere on cap 14, for instance on ledge 24 or on the outside surface of skirt 28, so long as the registration of pointer 16 with the digits can be clearly ascertained. Also, instead of a rotating pointer, one could have a rotatable disk with numbers around its periphery and a registering index mark at the edge of the cap, the disk being either centrally pivoted on the cap or slidably mounted in a circumferential groove or guide; or an annular ring, similarly numbered and slidably mounted at the periphery of the cap. Other alternatives to the rotating pointer of our preferred embodiment could be a marker that, e.g., slides along a track (e.g., circular or linear) secured to cap 14, adjacent to indicia; or a small token that is held to the cap by magnetism and can be moved around to cover up or point to numerals on the cap; or a movable cover on the cap that covers all except one digit; or an electronic display device that increments the displayed value when a button is pushed.

What is claimed is:

1. A use-monitoring closure for the open top of a tennis ball can comprising a cap for releasably attaching to and closing said open top, and a use totaller on said cap for counting, recording, and displaying the usage of tennis balls within the can.

2. The closure of claim 1 wherein said use totaller comprises a use counting member accessible and movable by a user's fingers to positions along a predetermined path on said cap, and means for providing counting indicia on said cap or member, said indicia relating to different positions along said path.

3. The closure of claim 2 wherein said indicia are at positions along said path.

4. The closure of claim 3 wherein said member is rotatably mounted about an axis perpendicular to and passing through said cap.

5. The closure of claim 4 wherein said member is a pointer that has an end that travels through a circle, and said indicia are along said circle.

6. The closure of claim 5 wherein said cap includes a flexible skirt, peripherally disposed on said closure, with a bead on its inner surface to snap-fit over said open top of said tennis ball can.

7. The closure of claim 6 wherein said cap includes a central panel and an annular ledge that is raised above said panel, and said pointer includes a bar that has a thickness dimension parallel to said axis that is smaller than said bar is wide and has an end supported by said ledge, said pointer also including a hub between said bar and said panel about said axis, whereby said bar is positioned above said panel by said hub and said ledge to facilitate access by a user's finger.

8. The closure of claim 7 wherein said cap includes an upwardly directed rib radially outward of said end of said pointer and higher than said thickness of said bar.

9. The closure of claim 6 wherein said cap and said pointer are made of plastic materials, said pointer being made of material that is harder than that of said cap.

10. The closure of claim 7 wherein said cap has a hole passing through said panel at said axis, and said pointer includes a post passing through said hole and an enlarged head on the other side of said cap from said hub.

11. The closure of claim 7 wherein said cap has a hole passing through said panel at said axis, and said pointer includes a post passing through said hole and an enlarged head on the other side of said cap from said hub, said hub being larger in diameter than said post, said cap being made of plastic that stretches downward near said hole around said post, forming an annular skirt providing tight contact against said post to resist rotation of said pointer by friction, said friction being small enough so that a single finger can easily reset said pointer but large enough to secure said pointer against accidental movement, said hub and said skirt providing seals against contamination of said tennis balls by moisture or dirt.

12. The closure of claim 1 wherein said cap is approximately three inches in diameter.

13. The closure of claim 3 wherein said cap includes a track along said path, and said member is mounted for movement along said track.

14. The closure of claim 13 wherein said path is linear.

15. The closure of claim 13 wherein said path is circular.

16. The closure of claim 9 wherein said cap is made of polyethylene or polypropylene and said pointer is made of nylon or polystyrene.

17. The closure of claim 2 wherein said indicia are numerals.

18. The combination comprising a tennis ball can for packaging new tennis balls and storing partially used balls between uses, said can having an open top, a cap for releasably attaching to and closing said open top, and a use totaller on said cap for counting, recording, and displaying the usage of tennis balls within the can.

19. A method of recording use of tennis balls comprising providing a tennis ball can for packaging new tennis balls and storing partially used balls between uses, said can having an open top, a cap for releasably attaching to and closing said open top, and a use totaller on said cap for counting, recording, and displaying the usage of tennis balls within the can, removing said balls from said can, playing tennis with said balls, returning said balls to said can, and counting the usage of said tennis balls on said totaller to reflect total usage of said balls.

* * * * *